US011191984B2

(12) United States Patent
Gaeta

(10) Patent No.: US 11,191,984 B2
(45) Date of Patent: Dec. 7, 2021

(54) ANTI-SINKING AND ANTI-FIRE SAFETY SYSTEM FOR BOATS

(71) Applicant: S.P.I.GA. S.A.S. DI GAETA CARMINE, Avellino (IT)

(72) Inventor: Carmine Gaeta, Avellino (IT)

(73) Assignee: S.P.I.GA. S.A.S. DI GAETA CARMINE, Avellino (IT)

( * ) Notice: Subject to any disclaimer, the term of this patent is extended or adjusted under 35 U.S.C. 154(b) by 414 days.

(21) Appl. No.: 16/304,208

(22) PCT Filed: May 11, 2017

(86) PCT No.: PCT/IB2017/052764
§ 371 (c)(1),
(2) Date: Nov. 23, 2018

(87) PCT Pub. No.: WO2017/203383
PCT Pub. Date: Nov. 30, 2017

(65) Prior Publication Data

US 2020/0316417 A1 Oct. 8, 2020

(30) Foreign Application Priority Data

May 25, 2016 (IT) ..... 102016000053650

(51) Int. Cl.
*A62C 3/10* (2006.01)
*A62C 99/00* (2010.01)
(Continued)

(52) U.S. Cl.
CPC ..... *A62C 3/10* (2013.01); *A62C 99/0036* (2013.01); *B63B 43/16* (2013.01); *B63B 2043/006* (2013.01)

(58) Field of Classification Search
CPC ..... A62C 3/10; A62C 99/0036; B63B 43/16; B63B 2043/006
(Continued)

(56) References Cited

U.S. PATENT DOCUMENTS

| | | | |
|---|---|---|---|
| 6,098,563 | A | 8/2000 | Walker |
| 6,327,988 | B1 | 12/2001 | Seidel |
| 2006/0016380 | A1 | 1/2006 | Braitberg |

FOREIGN PATENT DOCUMENTS

| | | | |
|---|---|---|---|
| CN | 202 201 150 | U | 4/2012 |
| DE | 25 25 202 | A1 | 12/1976 |

(Continued)

OTHER PUBLICATIONS

International Search Report, dated Sep. 1, 2017, from corresponding PCT/IB2017/052764 application.

*Primary Examiner* — Chee-Chong Lee
*Assistant Examiner* — Kevin Edward Schwartz
(74) *Attorney, Agent, or Firm* — Nixon & Vanderhye

(57) ABSTRACT

An anti-sinking and anti-fire safety system for boats includes inflatable devices, is installed in a first deflated configuration and assumes a second irreversibly inflated configuration, with a volume considerably greater than the first deflated configuration. Each inflatable device is connected to at least one dispenser expanding a predetermined quantity of non-inflammable foam within the corresponding inflatable device to assume the desired volume in the second inflated configuration. Each dispenser is connected to an activator to activate the corresponding dispenser by remote control of the user, sent by a control system. The emergency system also includes dispensers, connected to the activator expanding non-inflammable foam between the free spaces present between the inflatable devices already inflated, and in any other fire risk space. The non-inflammable foam sublimates
(Continued)

after a known time. The control system includes a processor and a communication interface.

16 Claims, 5 Drawing Sheets

(51) Int. Cl.
*B63B 43/16* (2006.01)
*B63B 43/00* (2006.01)

(58) Field of Classification Search
USPC ..... 169/62
See application file for complete search history.

(56) References Cited

FOREIGN PATENT DOCUMENTS

| | | | |
|---|---|---|---|
| WO | 88/00882 | A1 | 2/1988 |
| WO | 2008/096095 | A1 | 8/2008 |

ANTI-SINKING AND ANTI-FIRE SAFETY SYSTEM FOR BOATS

FIELD OF THE INVENTION

The present invention relates to the field of safety and emergency systems and, specifically, it relates to a buoyancy aid and, at the same time, a fire prevention which can be installed on any type of boat.

PRIOR ART

Known boats comprise a hull with a keel that, when viewed along the longitudinal axis, assumes, at least in the front portion, a V shape. This V shape facilitates the buoyancy of the boat in motion and is typical of planing type boats, whose hull section immersed in water decreases with increasing navigation speed, due to the carrier effect produced by the shape of the hull itself. Planing type boats contrast with displacement type boats.

Any boat of known type further comprises an engine room platform, on which the user typically walks, which separates the upper portion from the lower portion that is technically known as bilge. In order to impart sufficient rigidity to the hull, in the bilge area boats comprise a plurality of reinforced beams that extend both from stem to stern (longitudinal members) and between the two port and starboard beams (crosspieces).

It is known that boats may be subject to impacts against the bottom, cliffs, port facilities or other boats, which can cause leaks in the hull. These leaks make water penetrate inside the boat, which may cause the sinking thereof.

In large vessels, the problem of leaks is solved alternatively or in combination by using watertight bulkheads and double hulls. The first solution consists in delimiting sections of the hull so as to make them totally isolated from the others. In this way, in case of flooding, only the section affected by the leak would fill with water, but the buoyancy of the boat would remain sufficient to prevent it from sinking. However, this solution is not applicable to small boats and sailboats, whose bilge is very small in size, incompatible with the installation of such bulkheads.

The other anti-sinking solution, present in large ships, is the use of the double hull which ensures, in the event of a collision, the integrity of at least the internal hull. Once again, however, this solution is not applicable to small boats, both for reasons of weight and for reasons of cost. A double hull would cause a significant increase in the cost of the boat and it would also limit the maneuverability and would increase the weight thereof. Maneuverability and weight are two of the aspects most taken into account in small boats, as they allow greater ease of driving and allow installing engines with reduced power, with significant cost and energy saving.

There are several known systems consisting of inflatable devices that can be operated manually or automatically via sensors, such as the system described in U.S. patent 2006 016 380 A1, involving the installation of at least one inflatable floatation device at any position in the bilge of the hull. Said device is connected to a complex system of sensors that detect the presence of water inside the hull and, if necessary, actuate inflation means responsible for inflating the device.

Patent WO 2008 096095 A1 also describes a similar anti-sinking system consisting of a plurality of inflatable devices.

While such previously patented systems guarantee in any case the buoyancy of the damaged hull, unless the inflatable devices break, they tend to work the same way regardless of the location of the leak relative to the hull and its size. Another drawback thereof is the fact that they do not restrict in any way the entrance of water into the hull. An anti-sinking system able to determine the location of the damage to the hull, becoming active only at the affected portion, with the dual function of limiting the entrance of water and aiding the boat buoyancy, does not seem to exist in the prior art.

Another risk the boats might be subjected to, especially oil tankers, carrying highly flammable liquids, are fires, or at least the possibility of explosions. This risk is also present in passenger ferries, which always have at least one bridge dedicated to the transport of passenger cars. Given the lack of checks on vehicles entering the ferry, the risk increases and safety systems are almost non-existent. The recent chronicle shows that ordinary anti-fire systems, currently installed on ships, are not sufficient to control the devastating effects of these events.

The object of the present invention is to propose a system applicable to boats of any type and size which allows limiting the entrance of water into the hull in the event of breakage, allowing buoyancy of the boat even with damaged hull, preventing fires on board and, if they occur, limiting the damage.

DESCRIPTION OF THE INVENTION

According to the present invention, an anti-sinking and anti-fire safety system for boats of any type is provided.

Advantageously, said safety system consists of a plurality of inflatable devices 100 that cover the entire internal surface of hull 200 of the boat. As is known, hull 200 is reinforced by a plurality of longitudinal members 202 and a plurality of crosspieces 203 which cross one another, forming substantially right angles and dividing the internal surface of hull 200 in a plurality of rectangles. Such inflatable devices 100 are advantageously rectangular in shape, when deflated, and are adapted to adhere, preferably in an airtight manner, to a portion of two longitudinal members 202 and a portion of two crosspieces 203.

Advantageously, said inflatable devices 100 are initially installed in deflated configuration, adapted to occupy as little space as possible.

Advantageously, said inflatable devices 100 are connected each to a corresponding dispenser 103, in turn connected to a corresponding activation means 104.

Said activation means 104 are advantageously connected to a control system 105, through which the user controls the activation thereof in case of emergency. When the control is sent to said activation means 104, they actuate the corresponding dispensers 103 which release a predetermined amount of non-inflammable foam 106 adapted to irreversibly expand within the corresponding inflatable devices 100, making them assume a second inflated configuration, characterized by a much larger volume than the first deflated configuration. Advantageously, said control system 105 consists of a common processor 109 adapted to exchange data, by means of a communication interface 101, with the user.

Advantageously, said processor 109 can also receive information from three types of sensors optionally installed on the boat: wet sensors 110, operation sensors 102 and inertial sensors 111.

Said wet sensors 110 are advantageously installed in the space between said inflatable devices 100 and the internal surface of hull 200; they are adapted to detect the possible entrance of water inside the boat and through said processor 109, automatically actuate the corresponding inflatable devices 100 when the water detected exceeds a certain tolerance threshold.

Said operation sensors 102 are advantageously adapted to perform an operating check of all parts of the safety system and report the outcome to said processor 109. This check is performed automatically at predetermined intervals and has the advantage of allowing the user to replace any faulty parts before an emergency situation happens.

Said inertial sensors 111 are advantageously adapted to detect any impacts and through said 109 processor, to actuate the activation means 104 automatically when an impact exceeding a certain tolerance threshold is detected.

Advantageously, said safety system also consists of a plurality of dispensers 103, connected to the relative activation means 104 installed in the lower internal technical space 201 of the boat and in any spaces considered to be at risk of fires 204. In case of an emergency, after the activation of the inflatable devices 100, said dispensers 103 are adapted to release, in the spaces where they are installed, a predetermined amount of non-inflammable foam 106.*a* adapted to sublimate within a certain time after its expansion.

This advantageously allows preventing possible fires in the areas most at risk and recovering the objects present in said areas after the sublimation of the non-inflammable foam 106.*a*.

If the fire occurs anyhow, the presence of said inflatable devices 100 in inflated configuration and the expansion of the sublimating non-inflammable foam 106.*a* in the remaining spaces have the function of removing the oxygen from the area affected by the fire and thus, advantageously, delimiting the expansion and accelerating the extinction thereof.

Advantageously, through said communication interface 101, the user has the ability to select which inflatable devices 100 to inflate, by acting on the corresponding activation means 104, based on the location of the damage communicated by processor 109 through said sensors. Another advantage of the safety system of the present invention is that it can be installed on all existing ships, with particular reference to ferries that carry passengers and cars at the same time.

Said safety system is advantageously also installable within the various compartments 300-300' of oil tankers.

Advantageously, in this possible embodiment, said safety system is provided with a plurality of reversibly inflatable devices 100', each connected to the respective gas dispenser 107, in turn connected to the respective activation means 104. In this case, said gas dispensers 107 are adapted to introduce, inside the respective inflatable device 100, a predetermined amount of any gas, adapted to make said inflatable device 100 assume a volume such as to occupy, together with the other inflatable devices 100 installed at each compartment 300-300', the entire portion of compartment 300-300' free from the inflammable liquid transported. Preferably, the gas used is nitrogen.

In this way, advantageously, the highly inflammable gases evaporated from the liquid transported have no space to expand and the risk of fire is thus significantly reduced. Advantageously, each compartment 300-300' can be provided with at least one vent valve 310, connected to a common pressure sensor 320. These further devices are advantageously installed in the upper portion of compartment 300-300', so that they are never submersed by the liquid transported. The purpose of said pressure sensor 320 is, advantageously, to measure the internal pressure of compartment 300-300' and if said pressure exceeds a certain threshold value, the pressure sensor 320 activates the vent valve 310 that expels said highly inflammable gases evaporated from the liquid transported, outside of the ship, bringing the internal pressure back to an acceptable value.

Advantageously, said reversibly inflatable devices 100' are always in inflated configuration in the filled compartments 300-300', while the ship is in motion.

Said reversibly inflatable devices 100' are also advantageously provided with at least one valve 108 adapted to assume a closed configuration when the relative reversibly inflatable device 100' must be in the inflated configuration, said valve 108 also being adapted to assume an open configuration to allow the outlet of gas from said reversibly inflatable device 100' when the latter has to assume a deflated configuration again.

Also for the possible embodiment of the present invention, the activation means 104 are advantageously connected to a control system 105' through which the user triggers the activation thereof when the load in compartment 300-300' is complete.

Advantageously, said control system 105' consists of a common processor 109 adapted to exchange data, by means of a communication interface 101, with the user.

Advantageously, said processor 109 is also adapted to receive the information from said pressure sensors 320 and, consequently, to activate the corresponding vent valves 310.

At the end of the trip, in order to allow discharge of compartments 300-300', said control system 105' is also adapted to act on valves 108 of each reversibly inflatable device 100' to switch it to the deflated configuration.

DESCRIPTION OF THE FIGURES

The anti-sinking and anti-fire safety system for boats object of the present invention will be described hereinafter with reference to the accompanying figures, in which.

DETAILED DESCRIPTION OF THE INVENTION

Figure 1:
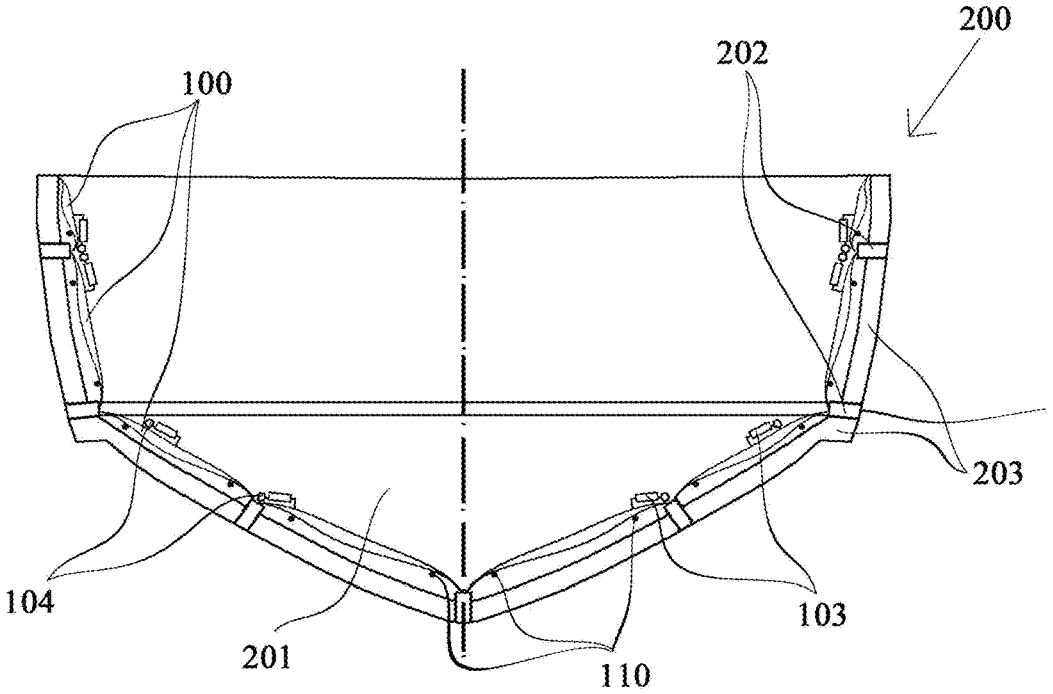
FIG. 1 shows a cross section of any boat, in which hull 200 is shown, reinforced by longitudinal members 202 and crosspieces 203 and the lower internal technical space 201; the inflatable devices 100 are also shown, each connected to the relative dispenser 103 in turn connected to the relative activation means 104, the wet sensors 110 can be seen on the outer surface of the inflatable devices 100.

With reference to FIG. 1, the section of any boat characterized by a hull 200 reinforced by a plurality of longitudinal members 202 and crosspieces 203 is shown. These reinforcing structures divide the inner surface of hull 200 in a plurality of substantially rectangular portions. As can be seen in the figure, each of these portions is covered with an inflatable device 100 that initially is installed in a first deflated configuration which occupies the least possible space.

Obviously, it is also possible to install larger inflatable devices 100, which cover multiple hull portions defined by two portions of longitudinal members 202 not consecutive and/or two portions of crosspieces 203 not consecutive.

Said inflatable devices 100 cover the entire inner surface of hull 200, both in the immersed and in the emerged part of the latter.

Each inflatable device 100 is connected to at least one dispenser 103, in turn connected to at least one activation means 104. Preferably, each activation means 104 corresponds to a single dispenser 103 and each dispenser 103 corresponds to a single inflatable device 100. For safety reasons, it is also possible to install multiple dispensers 103 connected to the same inflatable device and multiple activation means 104 connected to the same dispenser 103 so that, in case of failure of an actuation means 104 or a dispenser 103, the operation of the system is ensured by the presence of the other.

Figure 2:
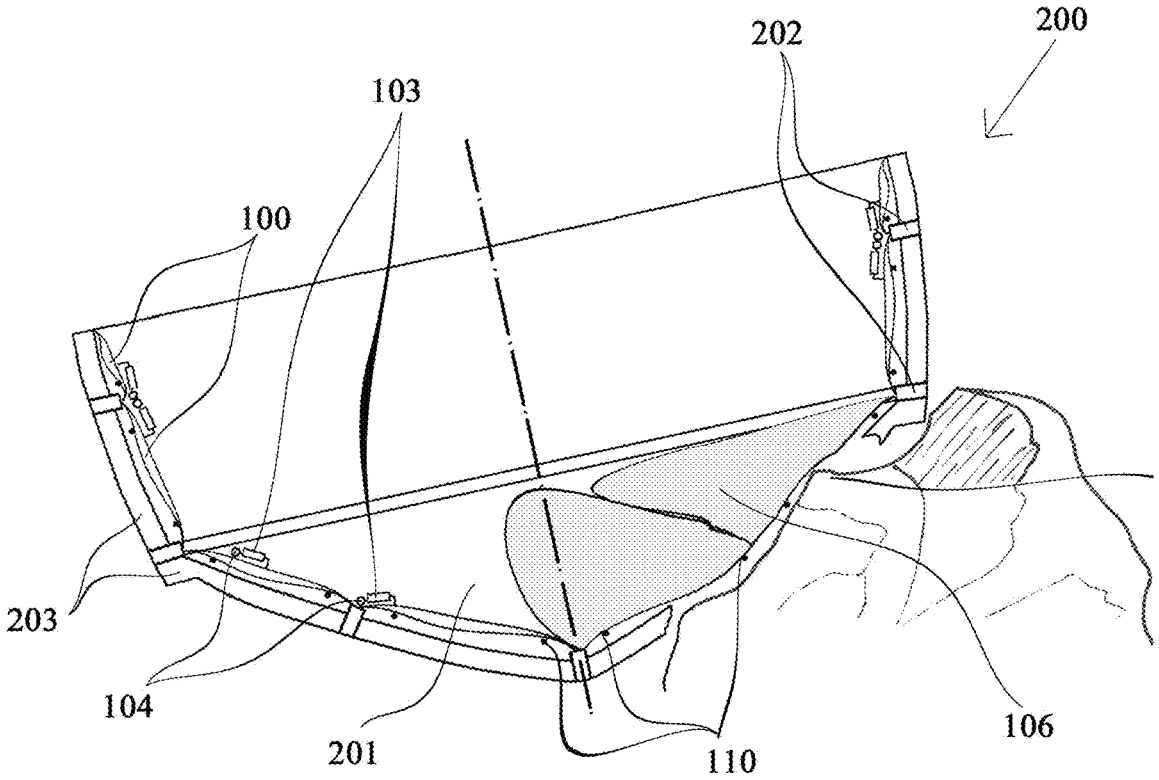
FIG. 2 shows the same boat of the previous figure on in a collision with a cliff that damages hull 200 thereof, the two inflatable devices 100 can be seen at the leak that are inflated of non-inflammable foam 106 by means of the corresponding dispensers 103 connected to the relative activation means 104.

With reference to FIG. 2, the same hull 200 of the previous figure is shown crashing against a cliff, getting severely damaged. At the leak it is seen that the corresponding inflatable devices 100 have been inflated with non-inflammable foam 106 dispensed by dispensers 103 and irreversibly expanded within said inflatable devices 100 to a second inflated configuration, characterized by a significantly larger volume than said first deflated configuration.

The actuation of the activation means 104 connected, through dispensers 103, to the inflatable devices 100 relative to the damaged hull portion 200 can also be automatic by installing, in the space existing between said inflatable devices 100 and the inner surface of hull 200, a plurality of wet sensors 110. When said wet sensors 110 detect an amount of water greater than a certain preset tolerance threshold, they report the anomaly to processor 109 and, without requiring the user's manual control, the appropriate activation means 104 are automatically actuated.

Figure 5:
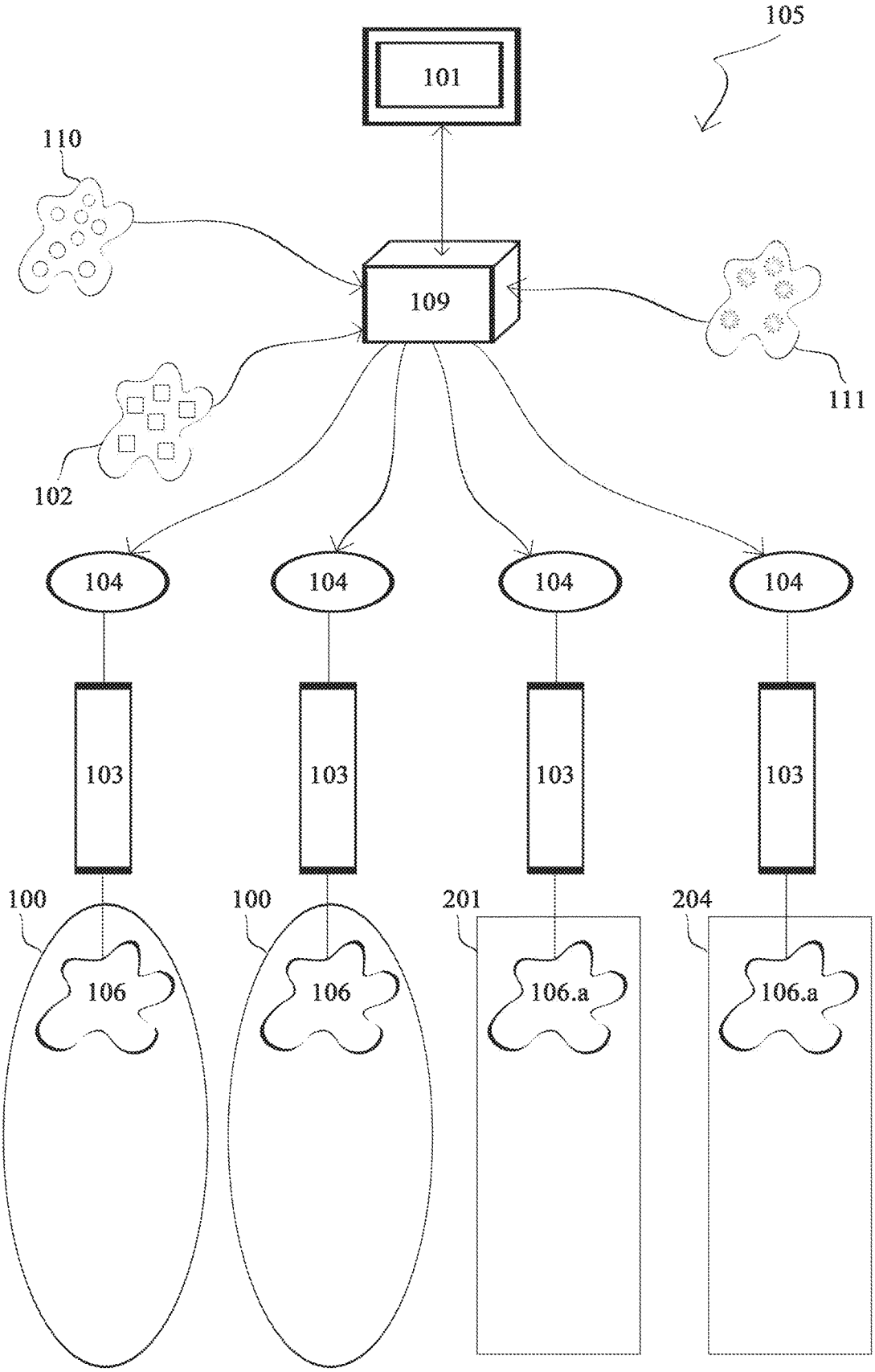
FIG. 5 shows a block diagram representing the operation of the control system 105 in which a processor 109 communicates and receives information to and from the user by means of a communication interface 101, said processor 109 receives inputs from the wet sensors 110, from the inertial sensors 111 and from the operation sensors 102 and sends, if necessary, the switch on control to the activation means 104, which open dispensers 103 containing non-inflammable foam 106-106.*a* which expands within the inflatable devices 100 or freely in the risk areas 204 and in the lower internal technical space 201.

The operation of processor 109 is shown in FIG. 5, where we can see that also two other types of sensors may be installed: operation sensors 102 and inertial sensors 111. The first ones are responsible for a functionality check that the system carries out automatically at predetermined time intervals. The results of this check are displayed to the user on the communication interface 101 that consists of a common electronic device. The presence of these operation sensors 102 allows the timely replacement or repair of any component of the safety system, thereby preventing unexpected malfunctions.

The inertial sensors 111 are capable of detecting collisions and are set at a certain tolerance threshold. When a collision is detected that exceeds this threshold, also in this case processor 109 automatically causes the actuation of the appropriate activation means 104.

Although foam 106 that expands within the inflatable devices 100 is non-inflammable, there is another safety feature implemented by the system of the present invention. In the lower internal technical space 201 and in all the fire risk spaces 204, a plurality of dispensers 103 are installed, connected to the respective activation means 104 which, after the switching of the inflatable devices 100 from the first deflated configuration to the second inflated configuration, expand in these compartments a particular, non-inflammable, sublimating foam 106.*a* which fills all the remaining volume. The characteristic of this second type of non-inflammable sublimating foam 106.*a* is that it is intended to sublimate within a known time interval from the moment of its expansion. Consider the case of a passenger ferry, one of the risk fire areas is definitely the deck occupied by cars. After a violent impact, the system enters into action and the whole deck is invaded by said non-inflammable sublimating foam 106.*a*. In this way, the propagation space of the possible fire is significantly reduced, as is the presence of oxygen in these spaces, thus reducing the risk of the occurrence and spread of fires. Moreover, due to the ability of said foam to sublimate, at the end of the emergency condition, it is sufficient to wait for the occurrence of the phenomenon to recover the cars.

One of the peculiarities of this safety system is that, through the communication interface 101, the user is able to view the exact point of the boat from which the emergency originates and he can control the actuation of the activation means relative to only the inflatable devices 100 or only the fire risk areas 204 affected by the event.

Figure 3:
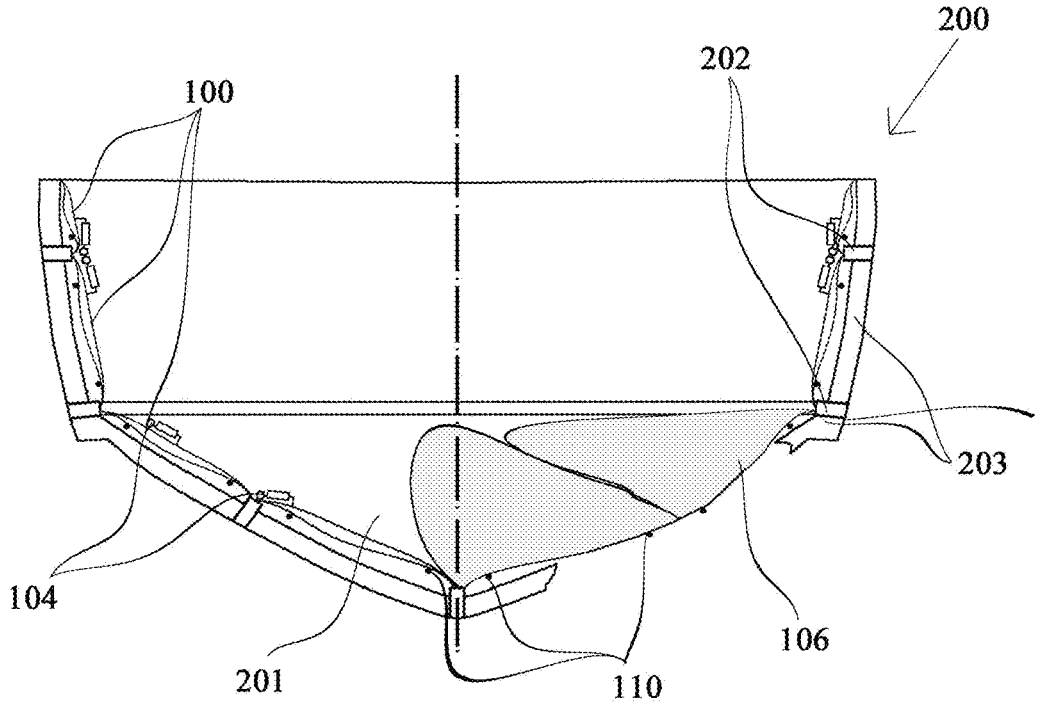
FIG. 3 shows how, after the opening of the leak, hull 200 is still able to float to reach the nearest port, due to the inflatable devices 100, filled with non-inflammable foam 106, which approximately recreate the original profile of hull 200 and limit the entrance of water into the lower internal technical space 201.
Figure 4:
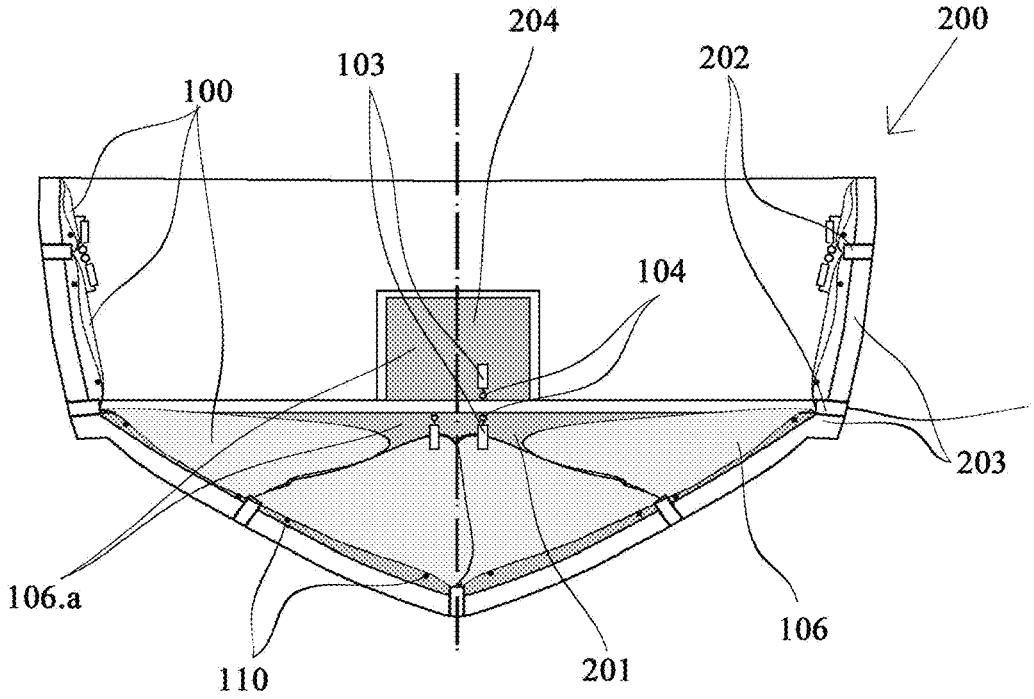
FIG. 4 shows the case in which, even in the absence of leaks in hull 200, the lower internal technical space 201 and the risk space 204 are filled with non-inflammable foam 106.*a* which sublimates within a known time interval, by the relative dispensers 103 and by the associated activation means 104, for preventing the risk of fire.

In this way, as shown in FIG. 3, even in case of serious incidents, the boat is able to find a buoyancy balance to reach the nearest port.

Figure 6:
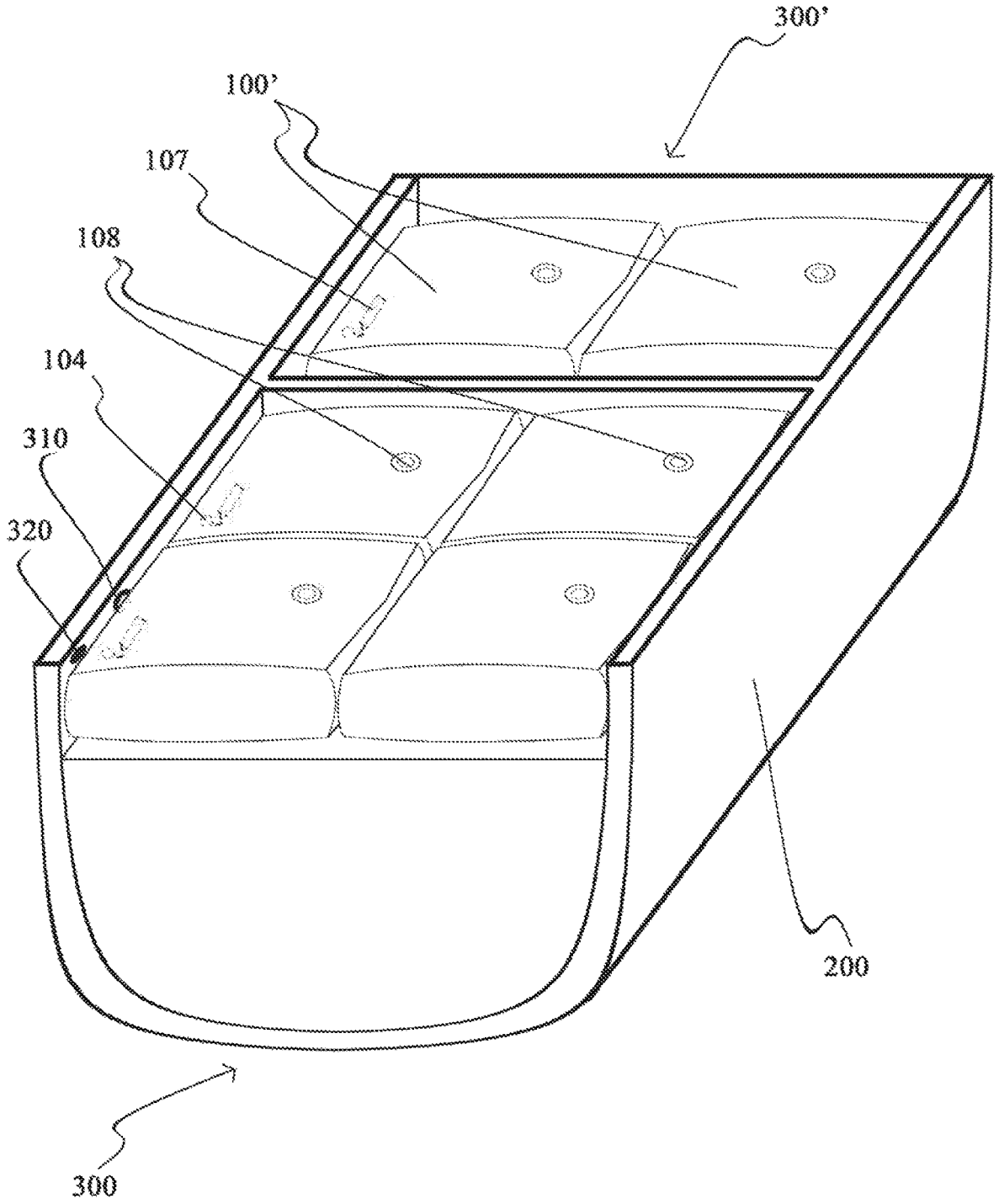
FIG. 6 shows an axonometric view of a hull 200 portion of an oil tanker capable of transporting two different liquids within two different compartments 300-300'; the upper portion of each compartment 300-300' is shown, the volume of which free from liquid is almost completely occupied by the reversibly inflatable devices 100', each of which is provided with a relative gas dispenser 107, a valve 108 and a corresponding activation means 104; at the compartment portion 300-300' free from the liquid transported, the vent valve 310 and the pressure sensor 320 connected thereto are shown.
Figure 7:
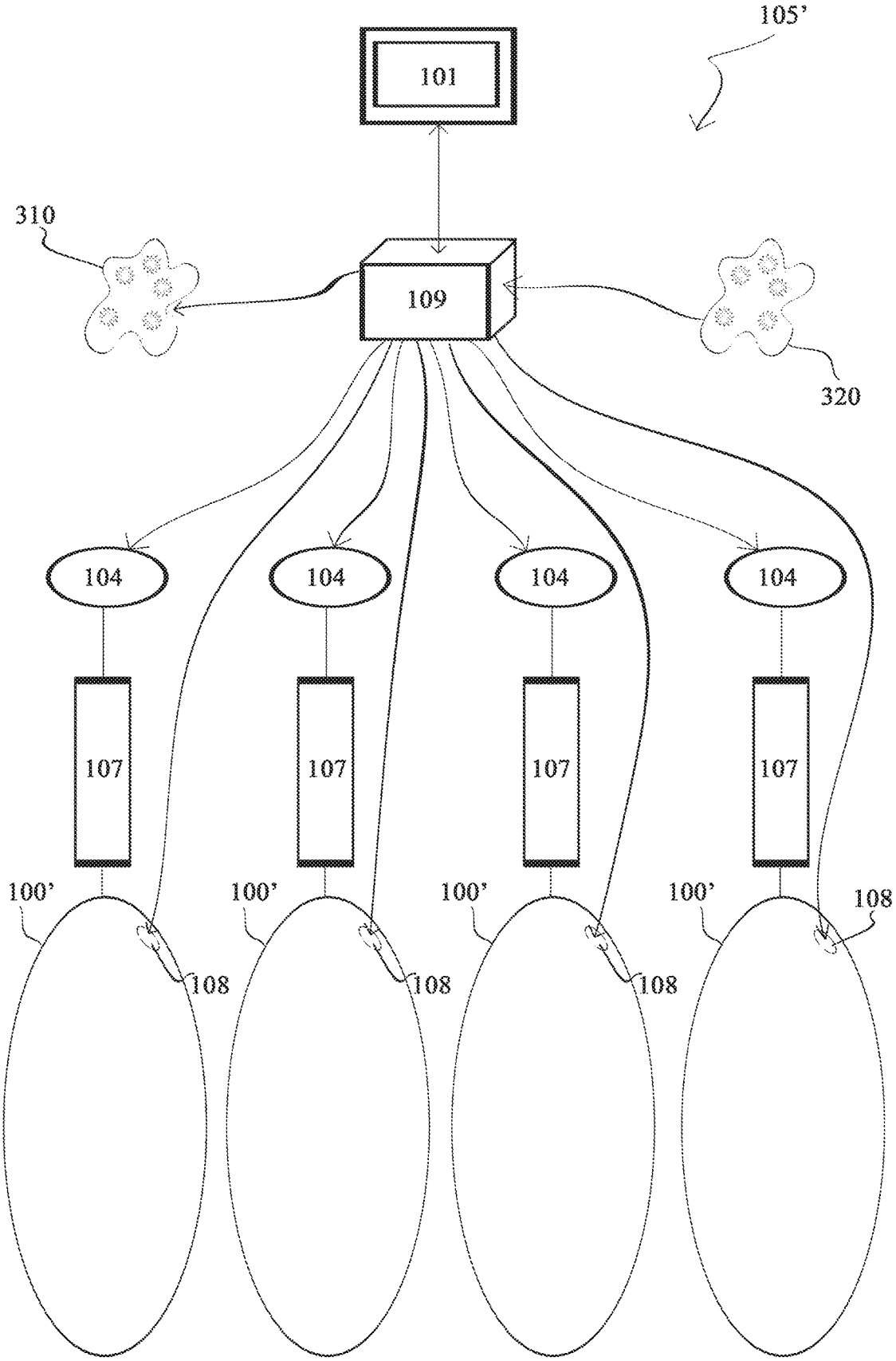
FIG. 7 shows a block diagram of the operation of the safety system in which a processor 109 communicates and receives information to and from the user via a communication interface 101, said processor 109 sends the switch on control to the activation means 104 which open the gas dispensers 107 relative to the reversibly inflatable devices 100' and also sends the opening control to valves 108 of each reversibly inflatable device 100' to cause the deflation thereof; said processor 109 also receives input data relating to the pressure sensors 320 and sends, in case of necessity, the opening control to the corresponding vent valves 310.

With reference to FIGS. 6 and 7, a possible variant of the invention is shown, in this case installed on a tanker adapted to carry highly inflammable liquids within its compartments 300-300'.

What makes each compartment 300-300' at high risk of fires is the presence, in the liquid free volume, of flammable gases evaporated from the transported liquid. In order to reduce the volume available for the expansion of such gases, the safety system of the present invention in this case consists of a plurality of reversibly inflatable devices 100' installed in each compartment 300-300'. Each of said reversibly inflatable devices 100' is connected to a gas dispenser 107, in turn connected to the relative activation means 104, controlled by the control system 105'. Once the load of compartment 300-300' has ended, said reversibly inflatable devices 100' are brought to the inflated configuration up to occupy almost all the volume free of the transported liquid.

During the trip, a certain amount of gas evaporates inevitably from the transported liquid, thereby increasing the internal pressure of the relative compartment 300-300'. To this end, at least one pressure sensor 320 is installed at each compartment 300-300' which, if an internal pressure exceeding a certain tolerance threshold is detected, is adapted, by means of said processor 109, to open the corresponding vent valve 310 to release said evaporation gases out of compartment 300-300', returning the internal pressure back to an acceptable value.

At the end of the trip, in order to allow the release of the liquid carried within each compartment 300-300', said reversibly inflatable devices 100' are returned to the deflated configuration by the control system 105' by opening valve 108 located on the surface of each reversibly inflatable device 100'.

Finally, it is clear that modifications, additions or variants may be made to the invention described thus far which are obvious to a man skilled in the art, without departing from the scope of protection that is provided by the appended claims.

The invention claimed is:

1. An anti-sinking and anti-fire safety system for boats, comprising:

a plurality of inflatable devices (100) that together cover an internal surface of a hull (200) of a boat, the hull having an original profile, the hull being reinforced by a plurality of longitudinal members (202) and a plurality of crosspieces (203), the longitudinal members (202) and the crosspieces (203) crossing one another at right angles and dividing the internal surface of hull (200) in a plurality of rectangles, the hull including a lower internal technical space (201), each inflatable device having four perimeter edges that are connected to a portion of two of the longitudinal members (202) and to a portion of two of the crosspieces (203), each inflatable device (100) being initially installed adjacent the hull in a portion of the lower internal technical space (201) and in a first deflated configuration occupying a first space, each inflatable device initially being of rectangular flattened form when deflated adjacent the hull, and said inflatable devices (100) being susceptible of assuming a second inflated configuration having a volume greater than said first deflated configuration;

plural dispensers (103);

plural activation valves (104); and a control system (105) constituted by a processor (109) adapted to allow a user, by means of a communication interface (101), to actuate a part or all of said activation valves (104), wherein, each activation valve (104) is connected to a corresponding one of the dispensers (103), each activation valve (104) is adapted to activate the corresponding dispenser (103) by means of remote control of a user, sent by means of the control system (105), each inflatable device (100) is connected to a corresponding one of said dispensers (103), each dispenser is adapted, responsive to the remote control of the user sent by means of said control system (105), to fill the corresponding inflatable device (100) with a predetermined quantity of non-inflammable foam (106) adapted to be expanded within said corresponding inflatable device (100) until said corresponding inflatable device (110) is allowed to assume a maximum desired pre-established volume in said second inflated configuration, wherein upon assuming the second inflated configuration, the inflatable devices recreate the original profile of the hull and limit entrance of water into the lower internal technical space (201), wherein said non-inflammable foam (106) is adapted to sublimate after a known time interval from its expansion.

2. The anti-sinking and anti-fire safety system for boats, according to claim 1, wherein each dispenser (103) is connected to only one inflatable device (100).

3. The anti-sinking and anti-fire safety system for boats, according to claim 1, wherein each activation (104) is connected to only one dispenser (103).

4. The anti-sinking and anti-fire safety system for boats, according to claim 1, wherein each of the four perimeter edges of each inflatable device (100) is connected to the portion of two of the longitudinal members (202) and to the portion of two of the crosspieces (203) by an airtight connection.

5. The anti-sinking and anti-fire safety system for boats, according to claim 1, wherein an external surface of each inflatable device (100), on a side directed towards the hull (200), is provided with a plurality of wet sensors (110), adapted to detect a possible entrance of water inside the hull (200), said wet sensors (110) also being adapted, by means of said processor (109) of said control system (105), to automatically actuate the corresponding activation valve (104) connected to the inflatable device (100) at which a leak has been detected, when the entrance of water exceeds a predetermined tolerance threshold.

6. The anti-sinking and anti-fire safety system for boats, according to claim 1, wherein said inflatable devices (100), when initially installed in the first deflated configuration, are configured so as to cover the entire internal surface of the hull (200), both for an immersed part of the hull and for an above-water, topside part of the hull.

7. The anti-sinking and anti-fire safety system for boats, according to claim 1, wherein said non-inflammable foam (106) is constituted by a polymer adapted to increase volume and adapted to maintain over time characteristics of fire resistance and buoyancy.

8. The anti-sinking and anti-fire safety system for boats, according to claim 1, wherein said control system (105) is also provided with a plurality of operation sensors (110), connected to said processor (109), adapted to carry out, at predetermined time intervals, a verification of operation of the safety system and adapted to communicate to the user an outcome of said verification by means of said communication interface (101).

9. The anti-sinking and anti-fire safety system for boats, according to claim 1, wherein each said activation valve (104) is connected to at least one inertial sensor (111) adapted to automatically actuate said activation valves (104) if an impact or a heeling was detected that exceeded a predetermined tolerance threshold.

10. The anti-sinking and anti-fire safety system for boats, according to claim 1, wherein said control system (105) allows the user a possibility to select which of the activation valves (104) to activate based on a placement of a leak that is displayed by means of said communication interface (101).

11. The anti-sinking and anti-fire safety system for boats, according to claim 1, wherein said non-inflammable foam (106) is constituted by expanded polyurethane adapted to increase volume and to maintain over time characteristics of fire resistance and buoyancy.

12. The anti-sinking and anti-fire safety system for boats, according to claim 1, wherein said inflatable devices (100), when initially installed in the first deflated configuration, cover all of the internal surface of hull (200) within the lower internal technical space (201) of the boat.

13. The anti-sinking and anti-fire safety system for boats, according to claim 12, wherein, with the inflatable devices in the second inflated configuration and filled with the non-inflammable foam (106), said inflatable devices recreate the original profile of hull (200) and limit the entrance of water into the lower internal technical space (201).

14. The anti-sinking and anti-fire safety system for boats, according to claim 1, wherein, with the inflatable devices in the second inflated configuration and filled with the non-inflammable foam (106), said inflatable devices recreate the original profile of hull (200) at a point of a water leak and limit the entrance of water into the lower internal technical space (201) at the point of the water leak.

15. The anti-sinking and anti-fire safety system for boats, according to claim 12, wherein each of the four perimeter edges of each inflatable device (100) is connected to the portion of two of the longitudinal members (202) and to the portion of two of the crosspieces (203) by an airtight connection.

16. The anti-sinking and anti-fire safety system for boats, according to claim 13, wherein each of the four perimeter edges of each inflatable device (100) is connected to the portion of two of the longitudinal members (202) and to the portion of two of the crosspieces (203) by an airtight connection.

* * * * *